United States Patent [19]

Talley et al.

[11] 4,435,860

[45] Mar. 13, 1984

[54] SPRING SUSPENSION FOR SOFA-BED

[75] Inventors: Thomas H. Talley, Downers Grove, Ill.; Lee W. Sheets, Muney Valley, Pa.; Alvin F. Wiley, Rushville, Ind.

[73] Assignee: Schnadig Corporation, Chicago, Ill.

[21] Appl. No.: 231,619

[22] Filed: Feb. 5, 1981

Related U.S. Application Data

[63] Continuation-in-part of Ser. No. 145,356, Apr. 30, 1980, abandoned.

[51] Int. Cl.[3] ..... A47C 17/04

[52] U.S. Cl. ..... 5/13; 5/51 P; 5/210

[58] Field of Search ..... 5/12 R, 13, 28, 51 E, 5/51 P, 56, 210, 229, 474; 248/601, 602, 162.1

[56] References Cited

U.S. PATENT DOCUMENTS

| | | | |
|---|---|---|---|
| 582,799 | 1/1897 | Randow | 248/602 |
| 815,610 | 3/1906 | Martin | 5/210 |
| 1,026,031 | 5/1912 | Grotenhuis | 5/210 |
| 1,387,388 | 8/1921 | Greenwood | 5/229 |
| 1,391,735 | 9/1921 | Jacobs et al. | 248/602 |
| 2,377,464 | 6/1945 | Tucker | 5/210 |
| 2,537,664 | 1/1951 | Golding | 5/210 |
| 3,380,083 | 4/1968 | Mikos | 5/13 |

FOREIGN PATENT DOCUMENTS

| | | | |
|---|---|---|---|
| 13994 | of 1896 | United Kingdom | 5/51 E |

*Primary Examiner*—Alexander Grosz

[57] ABSTRACT

The bed frame of a sofa-bed is resiliently supported within the sofa frame by spring suspension assemblies on each side of the frame. Each spring suspension assembly includes a first mounting bracket attached to the sofa frame, a second mounting bracket attached to the bed frame, and a resilient support between the first and second mounting brackets.

13 Claims, 22 Drawing Figures

Fig. 5
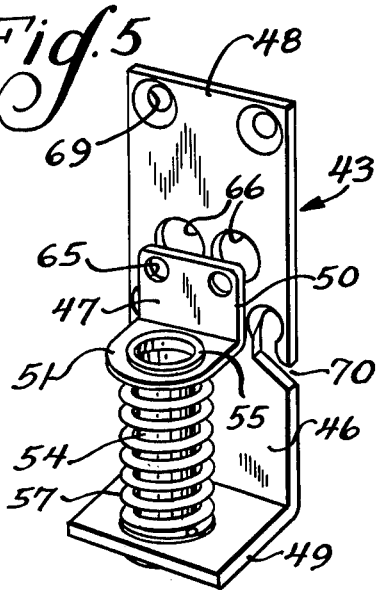
Fig. 6
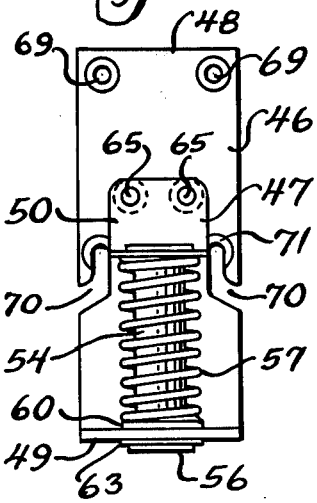
Fig. 7
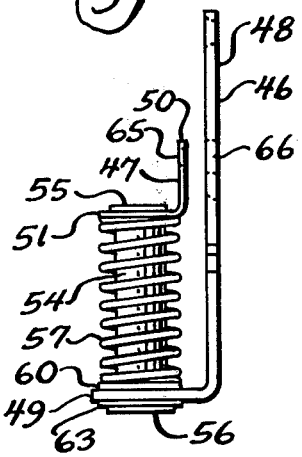
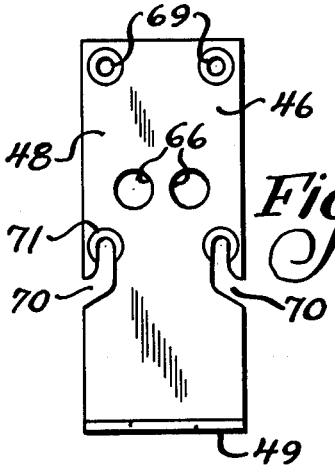
Fig. 8
Fig. 9
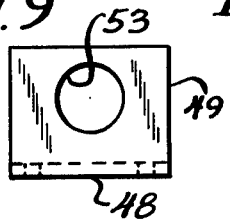
Fig. 10
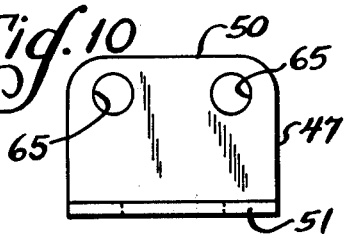
Fig. 11
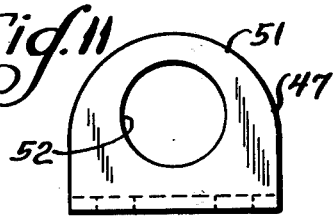
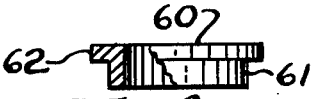
Fig. 12
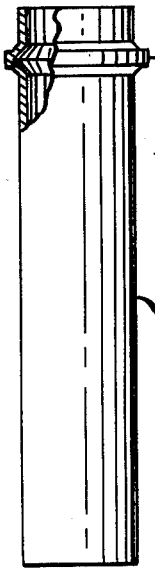
Fig. 13
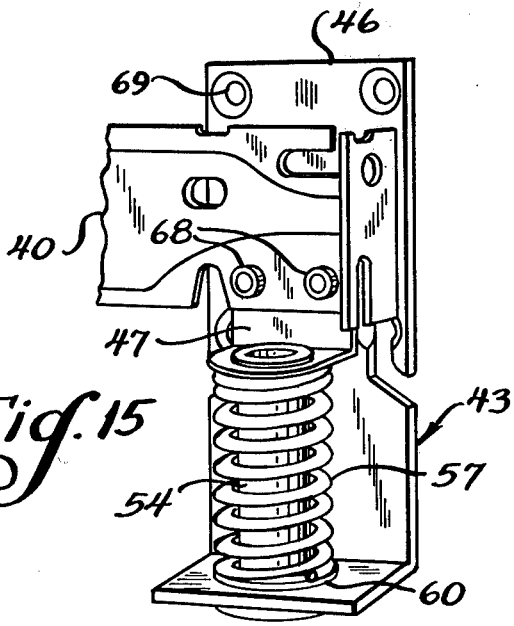
Fig. 15

SPRING SUSPENSION FOR SOFA-BED

RELATED APPLICATION

This application is a continuation-in-part of our copending application Ser. No. 145,356, filed Apr. 30, 1980 now abandoned.

BACKGROUND

This invention relates to convertible sofas or sofa-beds which include a foldable bed frame which can be unfolded to a sleeping position. More particularly, the invention relates to a spring suspension for resiliently supporting the bed frame inside the sofa frame.

Sofa-beds are well known and have been available for many years. The advantage of a sofa-bed is that it can be used both as a sofa and as a bed. One of the disadvantages of a sofa-bed is that, when used as a sofa, it is not as comfortable as a conventional sofa. This is because a conventional sofa includes a resilient support for the seat cushions, such as an inner spring, which is designed specifically for providing seating comfort. On the other hand, a sofa-bed is used for both sitting and sleeping, and comfort in both positions is comprised in order to accommodate the dual function.

A sofa-bed conventionally includes a sofa frame and a foldable bed frame. The bed frame is folded inside of the sofa frame when the sofa-bed is used as a sofa, and the bed frame is unfolded so that it extends forwardly from the front of the sofa frame when the sofa-bed is used as a bed. When the sofa-bed is used as a sofa, the seat cushions are supported by the bed frame and by the bed mattress, and the sofa feels relatively stiff or firm compared to a regular sofa.

SUMMARY OF THE INVENTION

The invention greatly increases the seating comfort of a sofa-bed by providing a spring suspension or floating support for the bed frame. A compressible spring resiliently supports the bed frame below each of the four corners of the seat cushion. When a person sits on the seat cushion, the seat cushion and the bed frame which supports the seat cushion can move downwardly to provide a cushioning action and a greater feeling of comfort.

DESCRIPTION OF THE DRAWING

The invention will be explained in conjunction with illustrative embodiments shown in the accompanying drawings, in which

FIG. 5 is a perspective view of one of the spring suspension assemblies of the first embodiment of the invention;

FIG. 6 is a side elevational view of one of the spring suspension assemblies of FIG. 5;

FIG. 7 is a front elevational view of one of the spring suspension assemblies;

FIG. 8 is a side elevational view of the mounting bracket for the sofa frame;

FIG. 9 is a bottom plan view of the mounting bracket for the sofa frame;

FIG. 10 is a side elevational view of the mounting bracket for the bed frame;

FIG. 11 is a bottom plan view of the mounting bracket for the bed frame;

FIG. 12 is an elevational view of the bushing for the mounting bracket for the sofa frame;

FIG. 13 is an elevational view of the tubular connector of the spring support assembly;

FIG. 15 is a fragmentary perspective view showing one of the spring suspension assemblies attached to the bed frame;

DESCRIPTION OF SPECIFIC EMBODIMENT

Figures 1, 2, 3, 4:
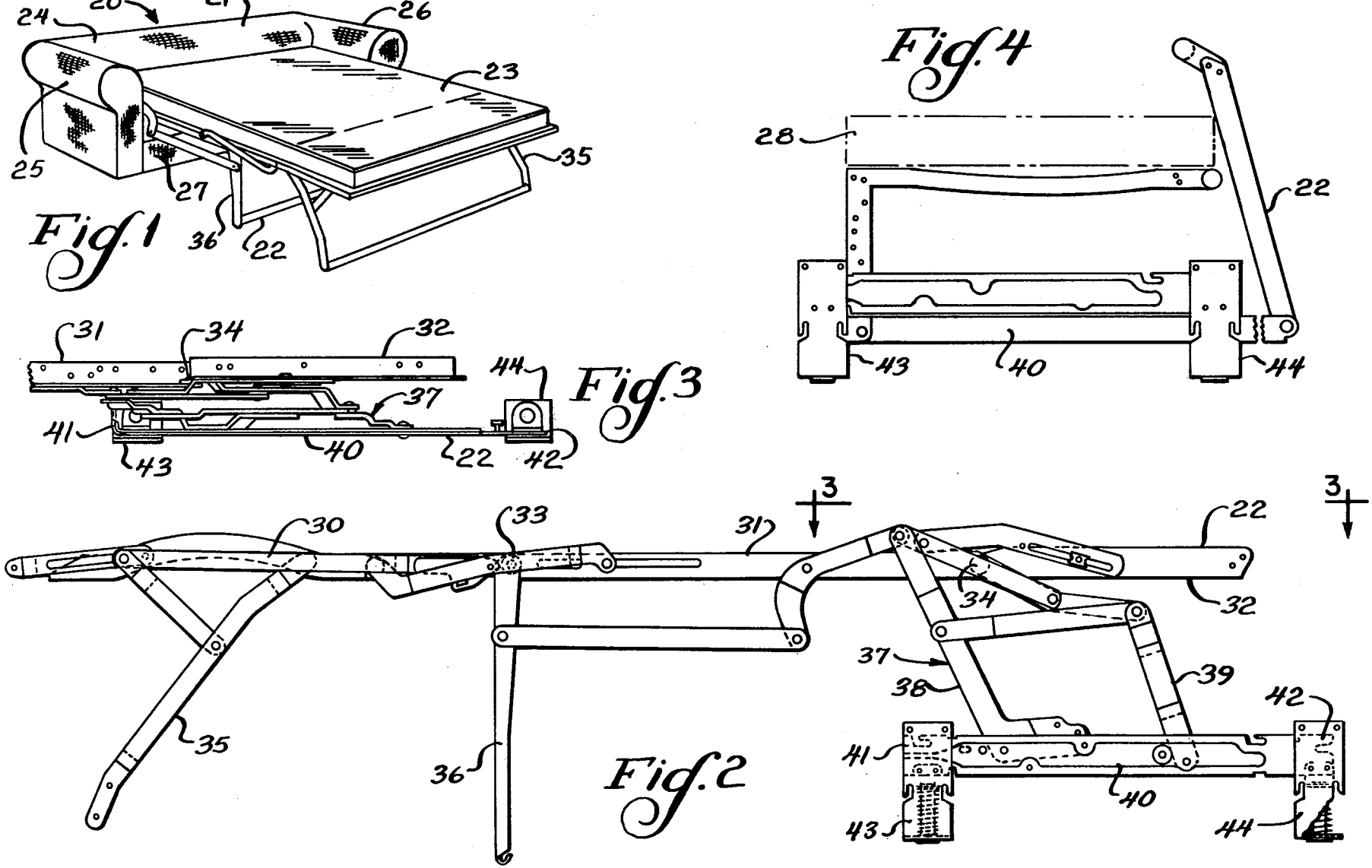
FIG. 1 is a perspective view of a sofa-bed with the bed frame unfolded to the sleeping position.
FIG. 2 is a side elevational view of the unfolded bed frame showing one embodiment of the invention.
FIG. 3 is a fragmentary top plan view of the unfolded bed frame taken along the line 3—3 of FIG. 2.
FIG. 4 is a fragmentary side elevational view of the bed frame folded to the sitting position, portions of the bed frame being omitted for clarity.

Referring first to FIGS. 1–3, a sofa bed 20 includes a sofa frame 21, a bed frame 22, and a mattress 23. The sofa frame is conventional and includes a back 24, a pair of arms 25 and 26 on each side of the sofa frame, and a front board 27. The bed frame and mattress are foldable between a sleeping position illustrated in FIG. 1 in which the bed frame and mattress extend horizontally from the sofa frame and a sitting position illustrated in FIG. 4 in which the bed frame and mattress are folded and positioned within the confines of the sofa frame. A seat cushion 28 (FIG. 4) is positioned over the folded mattress when the sofa-bed is used as a sofa.

The bed frame is also conventional except for its attachment to the sofa frame, which will be described in detail hereinafter. Since the bed frame is conventional and well known, it is unnecessary to explain it in detail. The bed frame includes a foot section 30, a middle section 31, and a head section 32 which are pivotally connected by pins 33 and 34. Conventional wire supports extend across the sections of the bed frame for supporting the mattress. The foot section is supported by a folding supporting leg 35, and the middle section is supported by a folding support leg 36. A parallelogram link mechanism 37 (FIG. 2) on each side of the bed frame supports both the middle section and the front section and permits the bed frame to be pivoted forwardly and downwardly into the area between the back of the sofa frame and the front board and between the arms (FIG. 4) so that the bed frame is confined within the sofa frame.

Each parallelogram link mechanism includes a pair of links 38 and 39 which are pivotally connected to a bottom rail 40 on each side of the bed frame. Each rail 40 has a front end 41 and a rear end 42, and the length of the rail is approximately the same as the front-to-back dimension of the seat cushion (see FIG. 4). Each end each side rail is resiliently supported on the sofa frame by front and rear spring suspension assemblies 43 and 44 so that the bed frame is resiliently supported below each of the four corners of the seat cushion. While I have referred to the seat cushion in the singular, it will be understood that the sofa can include a number of individual cushions depending upon the length and design of the sofa, and the term "seat cushion" should not be considered as being limited to a single cushion. Rather, it should be considered as referring to the cushioning material which covers the seating area of the sofa.

Referring now to FIGS. 5–7, each of the spring support assemblies includes a large L-shaped mounting bracket 46 which is adapted to be attached to the sofa frame and a small L-shaped mounting bracket 47 which is adapted to be attached to the bed frame. The large mounting bracket 46 includes a vertically extending attaching plate 48 which is attached to the sofa frame and a horizontally extending support plate 49. The small mounting bracket 47 similarly includes a vertically extending attaching plate 50 which is attached to the bottom rail 40 of the bed frame and a horizontally extending support plate 51.

The support plate 51 is provided with a circular opening 52 (FIG. 11), and the support plate 49 is provided with a circular opening 53 (FIG. 9). A tubular connector 54 extends through the openings 52 and 53, and the upper and lower ends of the tubular connector are flared over the support plates 51 and 49 at 55 and 56, respectively. A coil spring 57 surrounds the tubular connector and forces the support plates 51 and 49 against the flared ends of the connector.

The upper support plate 51 is captured at the upper end of the tubular connector 54 between the upper flared end 55 and radially outwardly extending crimp 59 (see FIG. 13) in the tubular connector. The upper support plate is thereby fixed against sliding movement relative to the tubular connector.

The lower end of the tubular connector is supported for sliding vertical movement relative to the lower support plate 49 by a nylon bushing 60 (see also FIG. 12). The bushing includes a cylindrical portion 61 which fits into the opening 53 in the lower support plate 49 and a radially outwardly extending shoulder 62 which is held against the top surface of the support plate by the spring 57. A washer 63 below the bushing extends radially beyond the opening in the support plate 49 and prevents the flared end 56 of the tubular connector from passing through the opening.

Figure 14:
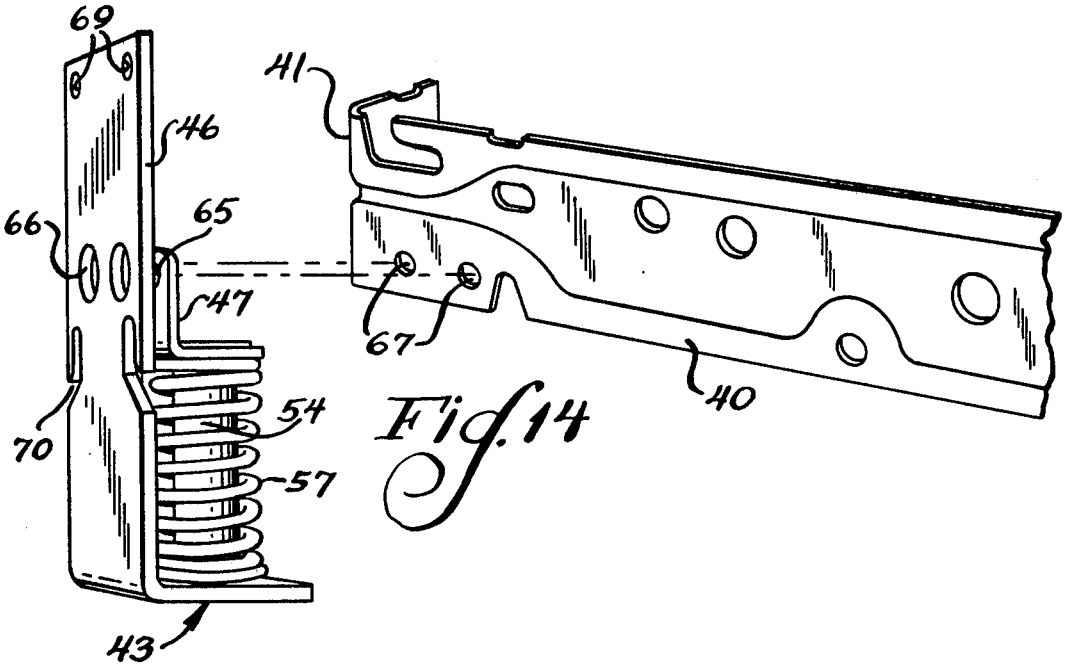
FIG. 14 is an exploded fragmentary perspective view illustrating one of the spring suspension assemblies being attached to the bed frame.
Figure 16:
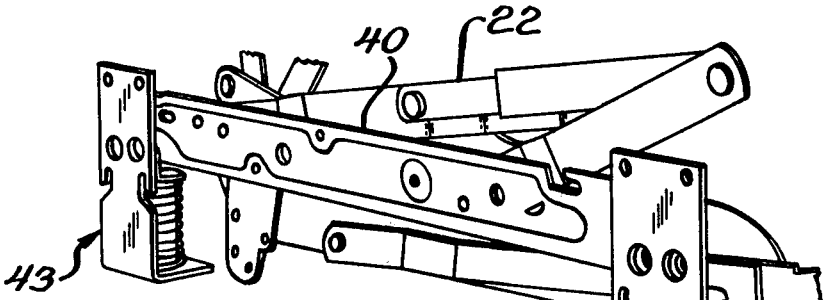
FIG. 16 is a fragmentary perspective view showing a pair of spring suspension assemblies attached to one side of the bed frame.

The attaching plate 50 of the small mounting bracket 47 is provided with two holes 65 to permit the small bracket to be attached to the bottom rail 40 of the bed frame. The attaching plate 48 of the large mounting bracket 46 is provided with two relatively large holes 66 which are aligned with the holes 65 (FIGS. 6 and 7) to facilitate attaching the small mounting bracket to the bed frame. Referring to FIG. 14, the front end of the bottom rail 40 is provided with a pair of openings 67 which are spaced apart the same distance as the openings 65, and the small mounting bracket 47 can be attached to the bed frame by fasteners which extend through the aligned openings 65 and 67. The openings 66 in the large mounting bracket are large enough to permit a riveting tool or the like to be used to attach the small bracket. FIG. 15 shows the spring suspension assembly 43 mounted on the front of the bottom rail 40 by rivets 68.

The attaching plate 48 of the large mounting bracket 46 is provided with a pair of countersunk openings 69 at the upper end thereof and a pair of angled slots 70 which extend inwardly and upwardly from the side edges. The upper end of each slot is countersunk at 71.

Figure 17:
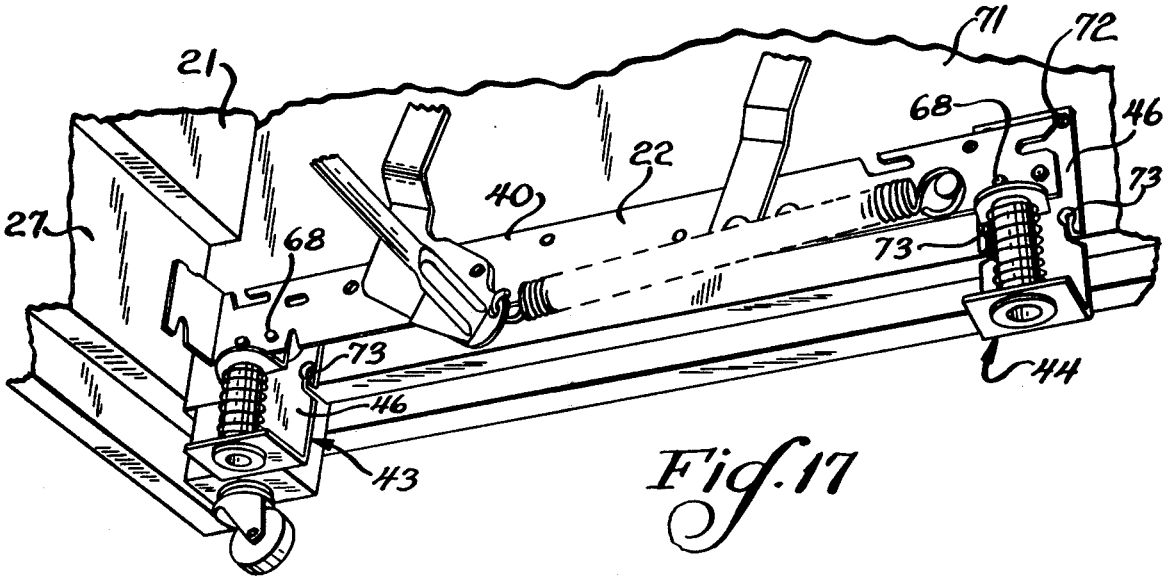
FIG. 17 is a fragmentary perspective view showing one side of the bed frame resiliently mounted on one side of the sofa frame by a pair of spring suspension assemblies.
Figure 18:
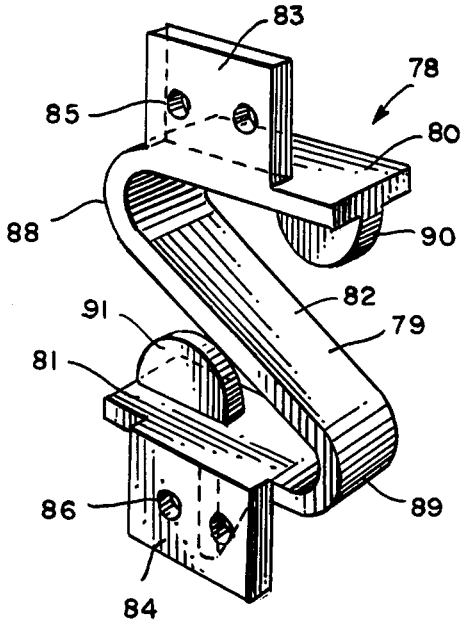
FIG. 18 is a perspective view of another embodiment of a spring suspension assembly.

FIG. 17 illustrates the bed frame 22 mounted on the sofa frame 21. The large mounting bracket 46 of each of the spring suspension assemblies 43 and 44 is attached to the side wall 71 of the sofa by screws 72 which extend through the openings 69 of the large mounting bracket and screws 73 which are positioned at the countersunk ends of the slots 70. In order to facilitate the positioning of the bed frame relative to the sofa frame, one of the screws 73 for each of the spring suspension assemblies can be screwed into the side wall of the sofa frame, and the entire bed frame can be lowered into the sofa frame until the screws 73 enter the slots 70 and support the front and rear ends of the bed frame on each side. The other screw 73 and the two screws 72 can then be inserted and tightened.

The only attachment between the bed frame and the sofa frame is provided by the spring suspension assemblies, and the spring suspension assemblies therefore provide a floating action for the bed frame when the bed frame is folded and the sofa-bed is used as a sofa. When a person sits on the seat cushion, the weight of the person compresses the coil spring 57 of each of the spring suspension assemblies and permits the bed frame to move downwardly. The tubular connector 54 slides through the bushing 60 in the bottom support plate 49 and guides the vertical movement of the bed frame mounting bracket 47. When the person stands up, the springs move the bed frame back to its original position. Fore-and-aft movement of the bed frame relative to the sofa frame is prevented by the tubular connectors 54.

Each coil spring is preferably preloaded or compressed even when the two mounting brackets are positioned at the ends of the tubular connector as illustrated in FIGS. 6 and 7. The preload prevents the bed frame from moving downwardly until the preload force is overcome. This prevents the spring from being compressed by the weight of the bed frame, the mattress, and the seat cushion. The preload may also be selected so that a certain force must be applied to the seat cushion before the spring will be further compressed and the bed frame will move downwardly. In one embodiment of the invention the springs had a spring constant of 123 pounds per inch and were preloaded to 75 pounds.

If desired, the springs at the rear end of the bottom rail 40 of the bed frame, which are under the rear corners of the seat cushion, can be weaker or have less of a preload than the springs at the front end of the bottom rail. This will enable the rear of the cushion to sink deeper as the person sits down and will provide a slight pitching action which will tilt the person against the back cushions.

In the specific embodiment illustrated, the bed frame was supported by four spring suspension assemblies, one below each of the four corners of the seating area. However, a modified floating action or suspension can be obtained by using only two suspension assemblies, one at each of the rear coorners of the seating area. The front end of the bottom rail of the bed frame can be attached directly to the sofa frame in a manner which will permit the rear of the bed frame to pivot downwardly.

The spring suspension assemblies shown and described utilize a compressible spring for resiliently supporting the support plate of the bed frame bracket above the support plate of the sofa bracket. However, equivalent means for resiliently supporting the bed frame relative to the sofa frame can also be utilized.

Another embodiment of a spring suspension assembly is illustrated in FIGS. 18–22. The assembly 78 includes a generally S-shaped spring portion 79 having flat upper and lower leg portions 80 and 81 which are connected by a cross member 82. An upper mounting bracket 83 extends upwardly from the upper leg, and a lower mounting bracket 84 extends downwardly from the lower leg. The upper mounting bracket is provided with a pair of openings 85, and the lower mounting bracket is provided with a pair of openings 86. A triangular reinforcing rib 87 extends between the lower mounting bracket 84 and the lower leg 81.

The entire spring suspension assembly can be formed integrally, and the particular spring suspension assembly illustrated was molded from flexible and resilient plastic or elastomeric material. Alternatively, the assembly can be formed from spring metal. When opposed vertical forces are exerted on the leg portions 80 and 81 of the assembly, the U-shaped transition portions 88 and 89 which join the leg portions to the cross member 82 act as hinges, and the leg portions move toward each other. When the forces are reduced or removed, the resilient suspension assembly tends to return to its original position.

A pair of semicircular stops 90 and 91 are molded onto the legs 80 and 81 and are engageable with the cross member 82 to prevent excessive compression of the spring suspension assembly.

Figure 22:
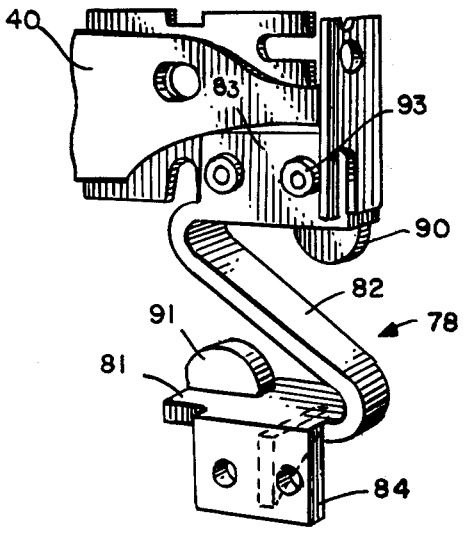
FIG. 22 is a view similar to FIG. 15 showing the spring suspension assembly of FIG. 18 attached to the bed frame.
Figure 20:
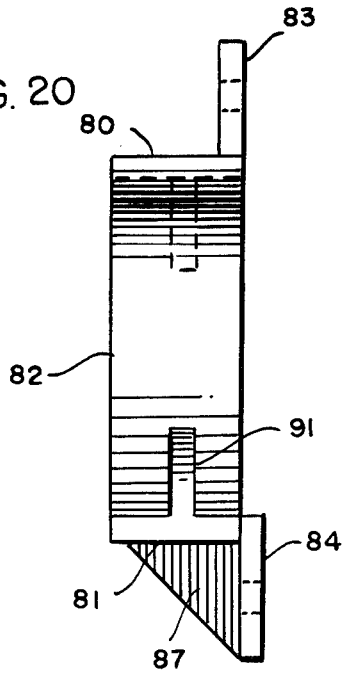
FIG. 20 is a side elevational view of the spring suspension assembly taken along the line 20—20 of FIG. 19.
Figure 19:
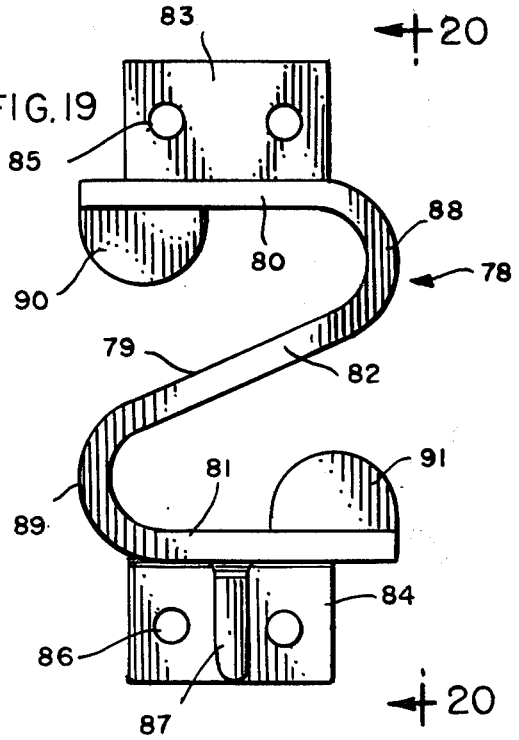
FIG. 19 is an elevational view of the spring suspension assembly of FIG. 18.
Figure 21:
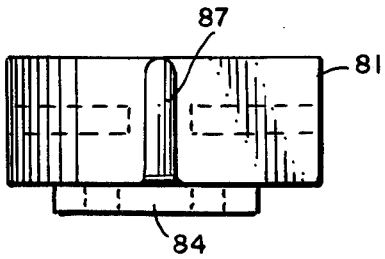
FIG. 21 is a bottom plan view of the spring suspension assembly of FIG. 20.

Referring to FIG. 22, the upper mounting bracket 83 is attached to the bottom rail 40 of the bed frame by bolts or rivets 93 which extend through the openings 85 in the mounting bracket. The lower mounting bracket 84 can be attached to the sofa frame by screws or bolts which can be inserted through the openings 86 in the lower mounting bracket.

A spring suspension assembly 78 may be positioned at each corner of the bed frame, and the spring suspension assemblies provide a resilient and compressible spring suspension for the bed frame.

While in the foregoing specification a detailed description of specific embodiments of the invention were set forth for the purpose of illustration, it will be understood that many of the details described herein may be varied considerably by those skilled in the art without departing from the spirit and scope of the invention.

I claim:

1. In a sofa-bed having a sofa frame and a folding bed frame, the sofa frame having a front, a pair of sides, and a back, the bed frame being foldable between a sitting position in which the bed frame is confined within the sofa frame and a sleeping position in which the bed frame extends forwardly from the sofa frame, the improvement comprising spring suspension means for resiliently supporting the bed frame on each of the sides of the sofa frame, each of the spring suspension means comprising a first mounting bracket attached to the sofa frame, a second mounting bracket attached to the bed frame, and resilient connecting means extending between the first and second brackets for movably and resiliently supporting the second mounting bracket relative to the first mounting bracket, the sofa-bed including a seat cushion supported by the bed frame when the bed frame is in the sitting position and including four of said spring suspension means for resiliently supporting the bed frame generally below the front and rear of the seat cushion on each side of the sofa frame, the resilient connecting means of each of the spring suspension means including a tube attached to one of the mounting brackets and slidably connected to the other mounting bracket and a compressible coil spring surrounding the tube between the two mounting brackets.

2. The structure of claim 1 in which the springs of the spring suspension means below the rear of the seat cushion are more compressible than the springs of the spring suspension means at the front of the seat cushion whereby the rear of the seat cushion will move downwardly more than the front of the seat cushion when a person sits on the seat cushion.

3. In a sofa-bed having a sofa frame and a folding bed frame, the sofa frame having a front, a pair of sides, and a back, the bed frame being foldable between a sitting position in which the bed frame is confined within the sofa frame and a sleeping position in which the bed frame extends forwardly from the sofa frame, the improvement comprising spring suspension means for resiliently supporting the bed frame on each of the sides of the sofa frame, each of the spring suspension means comprising a first mounting bracket attached to the sofa frame, a second mounting bracket attached to the bed frame, and resilient connecting means extending between the first and second brackets for movably and resiliently supporting the second mounting bracket relative to the first mounting bracket, the resilient connecting means of each of the spring suspension means including a tube attached to one of the mounting brackets and slidably connected to the other mounting bracket and a compressible coil spring surrounding the tube between the two mounting brackets.

4. In a sofa-bed having a sofa frame and a folding bed frame, the sofa frame having a front, a pair of sides, and a back, the bed frame being foldable between a sitting position in which the bed frame is confined within the sofa frame and a sleeping position in which the bed frame extends forwardly from the sofa frame, the improvement comprising spring suspension means for resiliently supporting the bed frame on each of the sides of the sofa frame, each of the spring suspension means comprising a first mounting bracket attached to the sofa frame, a second mounting bracket attached to the bed frame, and resilient connecting means extending between the first and second brackets for movably and resiliently supporting the second mounting bracket relative to the first mounting bracket, each of said first mounting brackets being generally L-shaped and including a generally vertically extending attaching portion which is attached to the sofa frame and a generally horizontally extending supporting portion, and each of said second mounting brackets being generally L-shaped and including a generally vertically extending attaching portion which is attached to the bed frame and a generally horizontally extending support portion which is spaced above the support portion of the first mounting bracket, each of said resilient connecting means including a generally vertically extending tube attached to the support portion of one of said mounting brackets and extending through an opening in the support portion of the other mounting bracket, and a compressible coil spring surrounding the tube between the two support portions.

5. The structure of claim 4 in which each of the coil springs is compressed between the two support portions of the two mounting brackets so that each of the springs exerts a preload support force on the mounting bracket attached to the bed frame whereby the bed frame will not move downwardly until a force sufficient to overcome the preload force of the springs is exerted on the bed frame.

6. In a sofa-bed having a sofa frame and a folding bed frame, the sofa frame having a front, a pair of sides, and a back, the bed frame being foldable between a sitting position in which the bed frame is confined within the sofa frame and a sleeping position in which the bed frame extends forwardly from the sofa frame, the improvement comprising spring suspension means for resiliently supporting the bed frame on each of the sides of the sofa frame, each of the spring suspension means comprising an upper mounting bracket attached to the bed frame, a lower mounting bracket attached to the sofa frame, and a compression spring between the upper and lower mounting brackets for movably and resiliently supporting the upper mounting bracket relative to the lower mounting bracket, said upper mounting bracket being movable downwardly toward said lower mounting bracket and said compression spring being compressible when a person sits on the bed frame.

7. The structure of claim 6 including means for preventing separation of the upper and lower mounting brackets beyond an initial position, said compression spring being compressed between the upper and lower mounting brackets so that the compression spring exerts a preload support force on the upper mounting bracket attached to the bed frame whereby the bed frame will not move downwardly until a force sufficient to overcome the preload force of the compression spring is exerted on the bed frame.

8. The structure of claim 6 in which the sofa-bed includes a seat cushion supported by the bed frame when the bed frame is in the sitting position and including four of said spring suspension means for resiliently supporting the bed frame generally below the front and rear of the seat cushion on each side of the sofa frame.

9. The structure of claim 8 in which the springs of the spring suspension means below the rear of the seat cushion being more compressible than the springs of the spring suspension means at the front of the seat cushion whereby the rear of the seat cushion will move downwardly more than the front of the seat cushion when a person sits on the sat cushion.

10. The structure of claim 6 in which the each of the compression strings is generally S-shaped and includes a first leg portion which is connected to the upper mounting bracket and a second leg portion which is connected to the lower mounting bracket.

11. The structure of claim 10 in which each of the compression springs means is integrally molded from plastic.

12. The structure of claim 10 in which each of the compression spring means is integrally formed from spring metal.

13. The structure of claim 10 in which each of the compression spring means is integrally molded from elastomeric material.

* * * * *

UNITED STATES PATENT AND TRADEMARK OFFICE

CERTIFICATE OF CORRECTION

PATENT NO. : 4,435,860

DATED : March 13, 1984

INVENTOR(S) : Thomas H. Talley et al

It is certified that error appears in the above-identified patent and that said Letters Patent is hereby corrected as shown below:

Col. 8, line 26, delete "means".

Col. 8, line 29, change "spring" to --springs-- and delete "means".

Col. 8, line 32, change "spring" to --springs-- and delete "means".

Signed and Sealed this

*Twelfth* Day of *June 1984*

[SEAL]

*Attest:*

GERALD J. MOSSINGHOFF

*Attesting Officer*

*Commissioner of Patents and Trademarks*